US005956551A

United States Patent [19]

Ahn

[11] Patent Number: 5,956,551

[45] Date of Patent: Sep. 21, 1999

[54] DEVELOPING DEVICE FOR ELECTROPHOTOGRAPHIC PROCESSOR PROVIDING MINIMIZATION OF VOID REDUCTION

[75] Inventor: Byung-Sun Ahn, Suwon, Rep. of Korea

[73] Assignee: SamSung Electronics Co., Ltd., Kyungki-do, Rep. of Korea

[21] Appl. No.: 08/924,245

[22] Filed: Sep. 5, 1997

[30] Foreign Application Priority Data

Sep. 5, 1996 [KR] Rep. of Korea ..... 96-38467

[51] Int. Cl.[6] ..... G03G 15/08

[52] U.S. Cl. ..... 399/256

[58] Field of Search ..... 399/119, 254, 399/256, 222

[56] References Cited

U.S. PATENT DOCUMENTS 5,291,242 3/1994 Takano ..... 399/119
5,294,968 3/1994 Ueda et al. ..... 399/256
5,355,199 10/1994 Bray ..... 399/256
5,369,474 11/1994 Yamada ..... 399/119
5,489,976 2/1996 Ichikawa et al. .
5,572,301 11/1996 Shiratori .
5,608,501 3/1997 Makino ..... 399/119
5,652,944 7/1997 Masuda et al. .
5,655,180 8/1997 Yasuda et al. .
5,655,195 8/1997 Ichikawa et al. .

*Primary Examiner*—Susan S. Y. Lee
*Attorney, Agent, or Firm*—Robert E. Bushnell, Esq.

[57] ABSTRACT

An electrophotographic processor including an operating lever which is fixed to a shaft. An agitator gear, mounted about the shaft, has a groove configured to receive a protrusion extending from the operating lever, the groove and protrusion defining a helical formation. When the drive gear of a drive motor drives the agitator gear, the helically-formed groove-and-protrusion convention urges the agitator to drive the operating lever, thus drive the shaft and agitator to stir the toner. When the control lever is rotated manually, the protrusion acts against the groove and urges disengagement of the agitator gear and drive gear.

26 Claims, 4 Drawing Sheets

DEVELOPING DEVICE FOR ELECTROPHOTOGRAPHIC PROCESSOR PROVIDING MINIMIZATION OF VOID REDUCTION

CLAIM OF PRIORITY

This application makes reference to, incorporates the same herein, and claims all benefits accruing under 35 U.S.C. §119 from an application entitled Developing Device for Electrophotographic Processor earlier filed in the Korean Industrial Property Office on Sep. 5, 1996, and there duly assigned Ser. No. 96-38467 by that Office.

BACKGROUND OF THE INVENTION

1. Field of the Invention

The present invention relates to a developing device for an electrophotographic processor such as a laser beam printer, copy machine, facsimile, or compound machine, and more particularly, to a developing device for an electrophotographic processor which prevents toner from hardening due to long-term stopping of a developing portion.

2. Description of the Prior Art

A conventional developing device for an electrophotographic processor includes: a photosensitive drum which is conductive when irradiated only; a charging roller which induces high voltage on the photosensitive drum; an exposure portion which imprints image data corresponding to character or picture signals from a computer and to a portion of the photosensitive drum; a developing roller which adheres charged toner powder onto the photosensitive drum; a high-voltage transfer roller which draws the toner powder onto the paper from the photosensitive drum; a toner fixing portion which fixes the toner on the paper at high temperature and voltage; a feeding portion which conveys the paper to a given position; and a driving portion by which all the above-mentioned components are organically driven with one another.

When the developing device experiences a long period between printing jobs, thus the toner is not agitated, or when the device is transported on a long, rough road reducing void volume of the toner. The toner powder tends to harden due to its strengthening coupling force. As a result, the agitator must impart an increased driving torque to stir the toner, sometimes exceeding the range of torque of the motor, resulting in the inability to drive and the failure of the agitator.

A need exists for a developing device which discourages the hardening of toner over long-term storage and/or arduous transportation.

U.S. Pat. No. 5,489,976 for a Toner Replenishing Device for a Developing Device of an Image Forming Apparatus issued to Ichikawa, describes a toner replenishing device including an engaging member used to transfer a driving force from an external drive to agitate toner stored in a cartridge. Referring to FIGS. 2 and 3, the cartridge 42 includes an agitator 421 with a rotary shaft 421*a*. An engaging portion 5 is mounted on the protruding end of shaft 421*a*, and is engageable with a drive mechanism. The device also includes a drive transmitting portion 6, including a drive shaft 60 connected to a drive source. In the event that the drive shaft experiences an excessive load, such as when toner stored in the toner cartridge has hardened, engaging member 52 moves against the action of the coil spring 51 due to the rotation of the connecting member 61, thus the engaging member 52 and connecting member 61 are disengaged from each other. Continued rotation of the shaft induces the ridge 52*c* to jump into the groove 61*f* due to the action of the coil spring 51, causing a vibration that loosens the toner.

U.S. Pat. No. 5,655,195 for a Toner Cartridge for Developing Device Included in an Image Forming Apparatus issued to Ichikawa et al., describes a device including an agitator that loosens hardened toner.

U.S. Pat. No. 5,655,180 issued to Yasuda et al. describes a Toner Cartridge with a Rotary Element Which Is Attachable to and Detachable from a Developing Apparatus, which, referring to FIGS. 2 and 3, includes a blade 12 mounted on a cone 11. The cone is adapted to be driven by a drive shaft 25. Referring to FIG. 18, another embodiment provides for driving the cone with a set of bevel gears. Referring to FIG. 24A, the device includes a driving element with a spiral-formed face. The device is intended to be driven continuously by the drive mechanism of the device in which the toner cartridge is mounted.

U.S. Pat. No. 5,652,944 for Serial Electrophotographic Apparatus with First and Second Supply Chamber with Stirring Arrangements issued to Masuda et al., provides a rotatable pedal including a gear which meshes with a plurality of other gears to permit a user to drive a toner stirring mechanism within a toner cartridge. U.S. Pat. No. 5,572,301 for Developing Device to Which Drive Transmission From a Cartridge Is Cut Off issued to Shiratori, describes a toner cartridge including a grip connected to a stirring mechanism which may be rotated by the user. Although not shown, a coupling for receiving a drive force from the developing device is provided on the opposite side of the toner cartridge engaged with the gear 5.

SUMMARY OF THE INVENTION

The present developing device includes: (1) a driving gear which transmits the driving force of a driving motor; (2) an agitator gear which transmits the driving force of the driving gear to a shaft of an agitator, engaging with the driving gear; (3) a shaft mounted at a central axis of the agitator gear; (4) an operating lever fixed at the shaft that, prior to the operation of developing device, rotates the agitator to stir toner; (5) a protrusion extending from the operating lever transmit power to the agitator gear to fix the position of the agitator gear; and (6) a spring coupled to a lower end of the operating lever, for switching the power of the driving gear to the agitator gear in accordance with the rotation of operating lever.

A first object of the present invention is to provide a developing device for an electrophotographic processor which minimizes void volume reduction in toner by stirring the toner prior to printing.

A second object of the present invention is to provide a developing device for an electrophotographic processor which prevents toner from hardening due to long-term stopping of the developing device.

A third object of the present invention is to provide a developing device for an electrophotographic processor which prevents the stalling a driving motor, thus the inability to print, caused by void volume reduction of toner.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
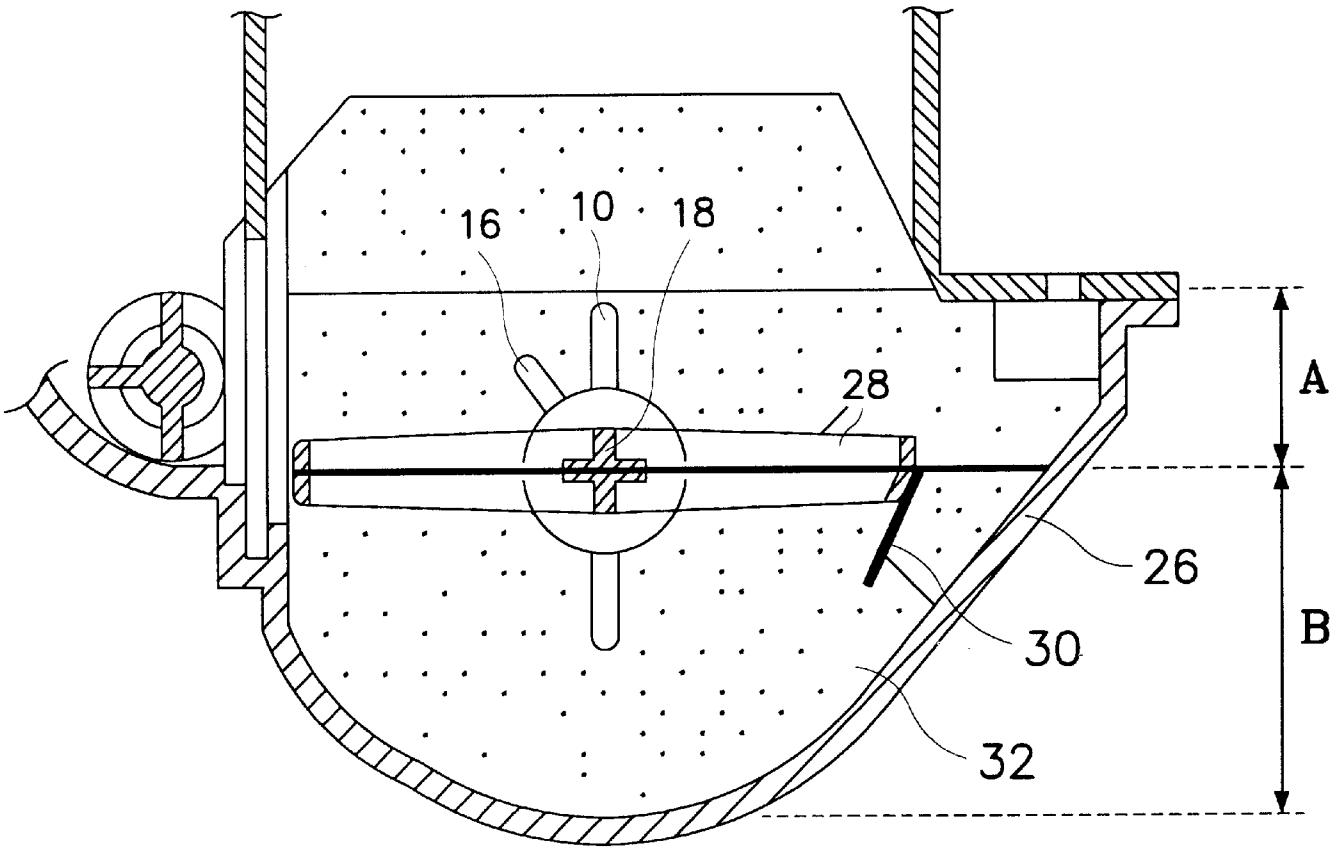
FIG. 1 is a vertical cross sectional detail view of a toner receptacle including the present toner agitator.

Referring to FIG. 1, when a developing device for an electrophotographic processor, according to a preferred embodiment of the present invention, is not used for a long period of time, the toner 32 in a toner loading portion 26 hardens.

Figure 2:
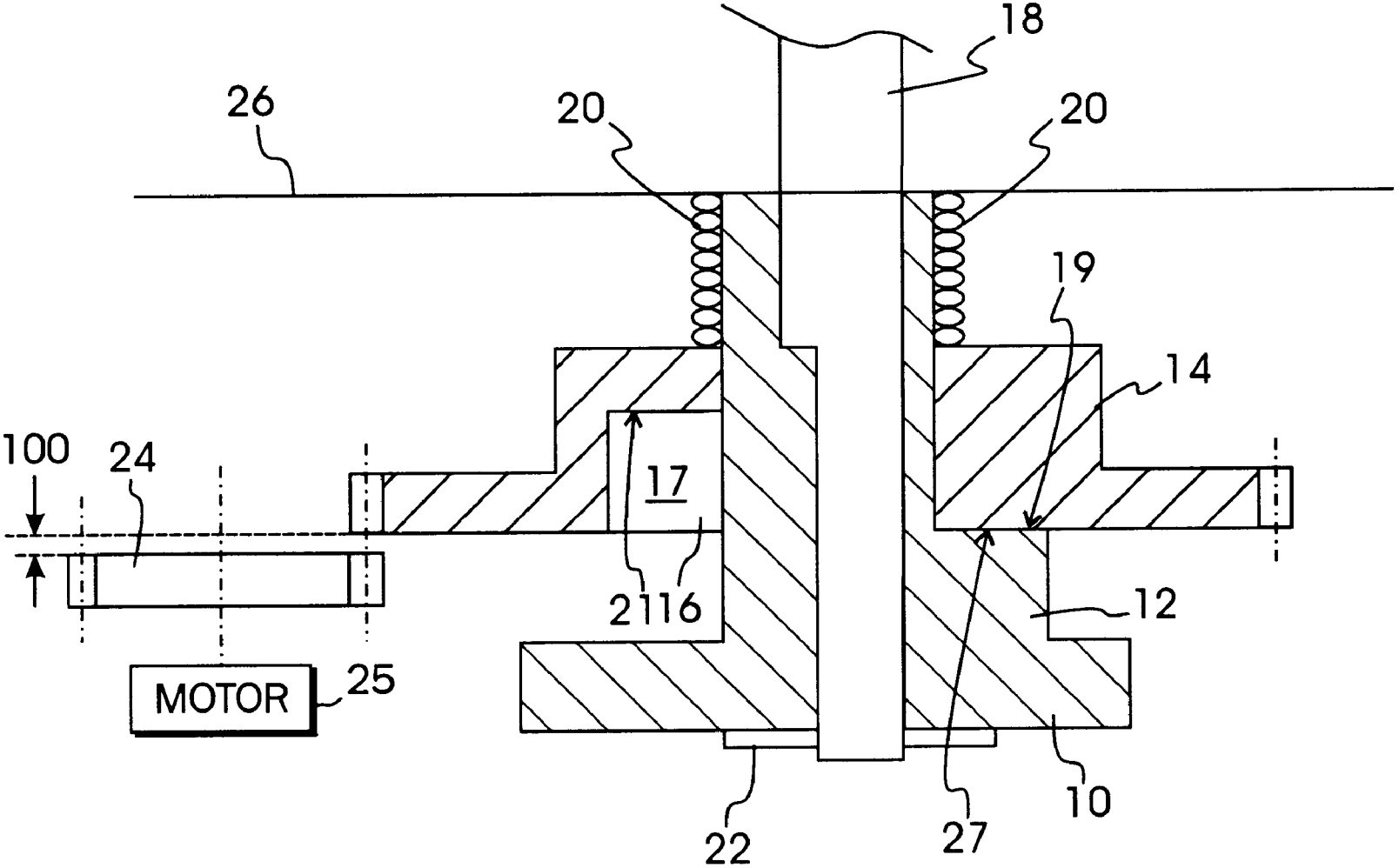
FIG. 2 is a horizontal cross sectional detail view of the present operating lever, agitator gear and driving gear, shown in the disengaged position.
Figure 3:
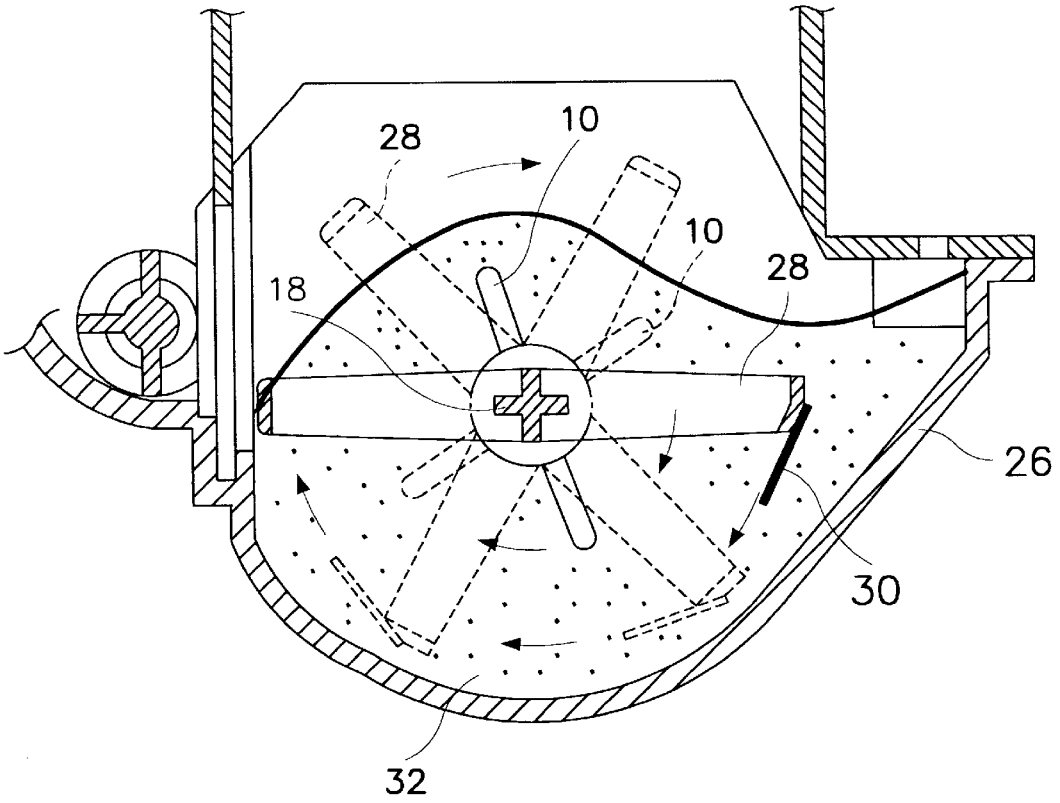
FIG. 3 is a vertical cross sectional detail view of the invention being employed to agitate toner.
Figure 4:
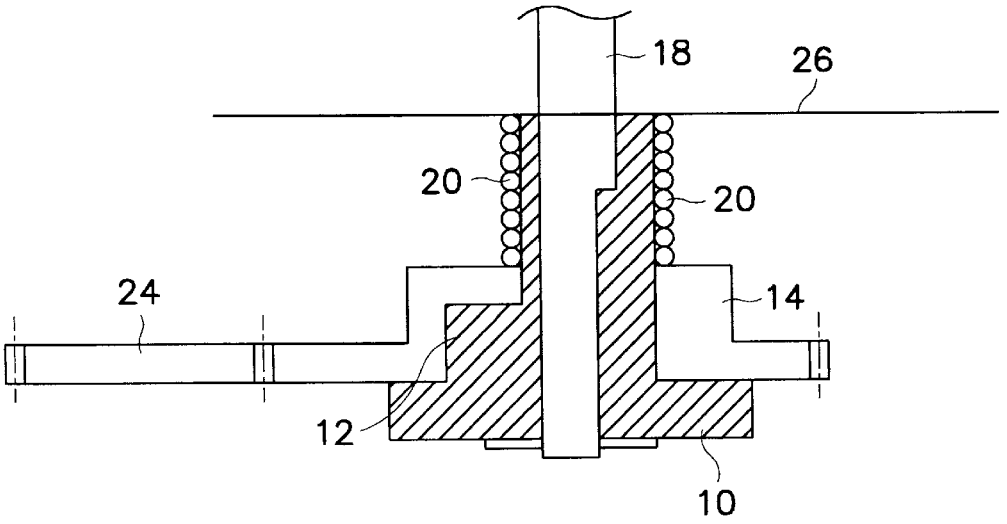
FIG. 4 is a horizontal cross sectional detail view of the embodiment shown in FIG. 2, in the engaged position.

Referring to FIGS. 2–4, power transmission means of the developing device of the present invention includes a driving gear 24 which receiving driving force from a driving motor (not shown). In FIG. 2, the agitator gear 14 is disengaged from the driving gear 24, whereas in FIG. 4, the agitator gear 14 is engaged with the driving gear 24. When engaged, agitator gear 14 transmits driving force to shaft 18, via an operating lever 10.

The operating lever 10 is mounted on a shaft 18. Between the operating lever 10 and shaft 18 is a spring clutch configuration for rotating shaft 18 in one direction, regardless of the rotating force of operating lever 10 washer 22 terminates one end of shaft 18 while engaging protusion 12.

A handle protruding from both sides is formed at a side of operating lever 10 for the convenience of users. A protrusion 12 is extended from the lower end of the operating lever 10. Protrusion 12 transmits the driving force of the driving motor to agitator gear 14, when protusion 12 properly seated in the groove 16 of the agitator gear 14. Protrusion 12 of operating lever 10 is longer than groove 16 of agitator gear 14 so that a fixed gap 100 may be maintained so that driving gear 24 and agitator gear 14 do not come into contact with each other. Protrusion 12 and groove 16 are tapered in a helical form, in accordance with the rotation direction. This engagement convention fosters manual rotation of the operating lever in one direction, such as clockwise, with the helical formation urging the agitator gear out of engagement with the driving gear. When the motor 25 drives the agitator gear in the same direction, for the helical formation urges engagement with the driving gear. An elastic element, such as a spring 20 is mounted on the shaft 18, bias the agitator gear 14 toward engagement with operating lever 10.

Figure 5:
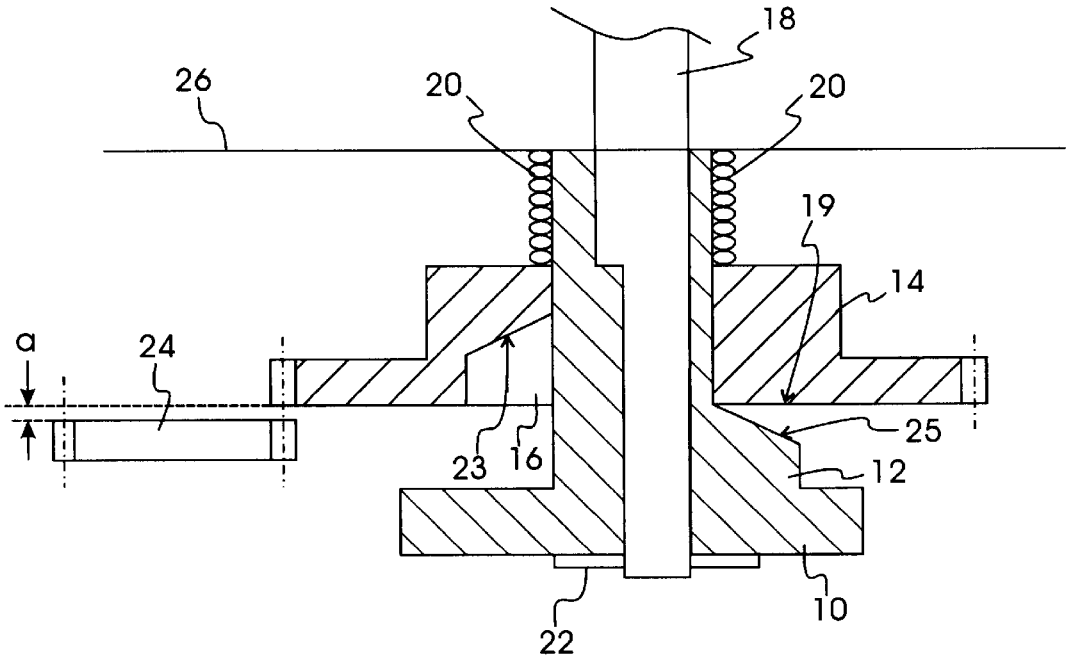
FIG. 5 is a horizontal cross sectional detail view of the present operating lever, agitator gear and driving gear, shown in the disengaged position, drawn along a line midway along the helical groove-and-protuberance formations.
Figure 6:
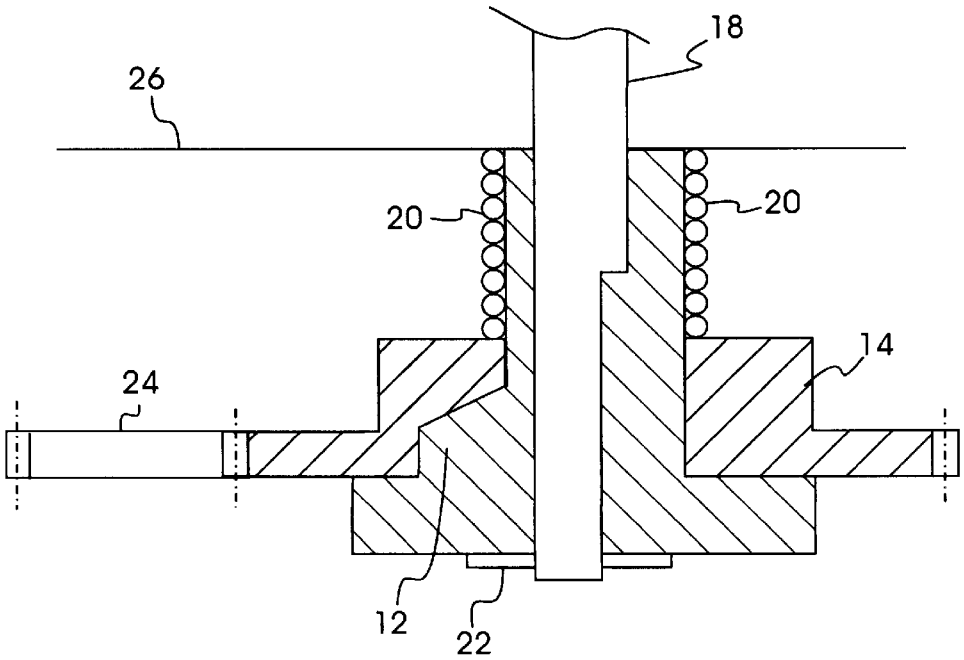
FIG. 6 is a horizontal cross sectional detail view of the present operating lever, agitator gear and driving gear, shown in the engaged position, drawn along a line midway along the helical groove-and-protuberance formations.

Referring also to FIGS. 5 and 6, the clutch feature of the present invention is achieved with the complementary groove 16 and protrusion 12. The groove 16 has an axially-aligned face 17 which abuts a complementary face (not shown) of the protrusion, as shown in FIG. 2. From the top of the protrusion 19, and the corresponding bottom of the groove 21, the protrusion 12 and groove 16 assume complementary helical surfaces 25 and 23, respectively, as shown in FIGS. 5 and 6. When the operating lever 10 is rotated other than by the agitator gear 14, i.e. manually, the faces disengage and the operating lever 10 slides relative to the agitator gear 14 along the helical surfaces therebetween. As the operating lever 10 is rotated, the top of the protrusion 19 glides over the high point of the groove 27 just before falling into the asymptotically proximate bottom of the groove 21. This well-known ratchet-like convention commonly is employed in child-safety caps for medicine bottles or poisonous liquid containers.

In operation, after a long inactive duration or arduous journey, a user may rotate operating lever 10 in one direction, as depicted in FIG. 2. The shaft, turn, rotates agitator 28. As a result, agitator 28 uniformly stirs toner 32 in toner loading portion 26.

When the user finishing loosening of the toner, as illustrated in FIG. 5, protrusion 12 of operating lever 10 is inserted into groove 16 of agitator gear 14. The agitator gear 14 engages with driving gear 24 by the force of elastic means 20. Thereafter, the driving motor drives driving gear 24, thus agitator gear 14. Shaft 18 rotates agitator 28 and an extension 30 mounted on the tip of agitator 28, by the driving force of agitator gear 14.

As described above, the developing device for the electrophotographic processor, according to the present invention, uniformly stirs hardened toner due to the vibration caused by long-distance movement of the developing device and/or the long-term stopping of the printing function.

It should be understood that the present invention is not limited to the particular embodiment disclosed herein, but rather includes all embodiments and modifications that fall within the scope of the appended claims.

What is claimed is:

1. A developing device for an electrophotographic processor, comprising:

a toner loading portion in which a large quantity of toner is filled;

an agitator mounted inside the toner loading portion, for uniformly stirring the toner; and an operating lever installed at a shaft which is coupled to a central axis of the agitator, in order to rotate the agitator in one direction for uniform toner stirring.

2. The device according to claim 1, wherein the operating lever is integrally formed in a mold with the shaft to rotate the agitator by driving force of a driving motor.

3. A developing device for an electrophotographic processor comprising:

a driving gear for transmitting driving force of a driving motor;

an agitator gear for transmitting the driving force of the driving gear to a shaft of an agitator, and the shaft to rotate the agitator by the driving force of the agitator gear, said device comprising:

an operating lever fixed at the shaft, for rotating the agitator for uniform toner stirring, prior to driving this device;

a protrusion formed in the operating lever, for power transmission to the agitator gear and agitator gear's position fixing; and elastic means which is coupled at the lower portion of the operating lever, for switching power of the driving gear to the agitator gear in accordance with the rotation of the operating lever.

4. The device according to claim 3, wherein the elastic means is in the form of a compression spring.

5. The device according to claim 3, wherein in the agitator gear is formed a groove into which the protrusion is inserted after the rotation of the operating lever.

6. The device according to claim 5, wherein the protrusion is longer than a depth of the groove so that a fixed gap may be maintained when the driving gear and the agitator gear come off each other.

7. The device according to claim 5, wherein the protrusion and the groove are tapered in a helical form, in accordance with a direction of rotation.

8. The device according to claim 3, wherein the agitator gear and the driving gear are spur gears.

9. The device according to claim 3, wherein at the shaft where the operating lever is installed, is formed a spring clutch or a one-direction clutch to rotate the shaft in one direction, regardless of rotating force of the operating lever.

10. An apparatus for agitating toner in an electrophotographic processor, comprising:

a shaft rotatably mounted on a receptacle for toner of the electrophotographiic processor;

an agitator, mounted on said shaft, configured to agitate toner received in the receptacle;

an operating lever mounted on said shaft;

an agitator gear drivingly mounted on said operating lever, to alternately axially shift position between a driving position transmitting rotary energy from a source of motive power to said operating lever and a non-driving position interrupting transmission of said rotary energy from the source to said operating lever; and means for urging said agitator gear into said non-driving position when said operating lever is driven.

11. The apparatus according to claim 10, further comprised of when said agitator gear assumes said driving position, a driver rotates said agitator gear and said agitator gear rotates said operating lever.

12. The apparatus according to claim 10, further comprised of said agitator gear being biased toward said driving position.

13. The apparatus according to claim 10, said agitator gear further comprising a groove and said operating lever further comprising a protrusion received in said groove.

14. The apparatus according to claim 13, said protrusion further comprised of a length and said groove further comprised of a depth, said length being greater than said depth.

15. The apparatus according to claim 13, further comprised of said protrusion contacting said agitator gear in said non-driving position.

16. The apparatus according to claim 13, further comprised of said protrusion and said groove defining a helical formation about an axis of rotation of said operating lever and said agitator gear.

17. The apparatus according to claim 13, further comprised of when said operating lever is driven by means excluding a driver, said protrusion ratchets beyond said groove.

18. A method for agitating toner in an electrophotographic processor, comprising the steps of:

connecting an operating lever to an agitator;

driving said operating lever, said operating lever being drivable by an agitator gear, said operating lever urging disengagement from said agitator gear when driven other than by said agitator gear.

19. The method of claim 18, further comprised of said agitator gear being biased toward engagement with said operating lever.

20. The method of claim 18, further comprised of said agitator gear being drivingly mounted on said operating lever, to alternately axially shift position between a driving position transmitting rotary energy from a source of motive power to said operating lever and a non-driving position interrupting transmission of said rotary energy from the source to said operating lever.

21. The method of claim 18, further comprised of when said agitator gear drives said operating lever, a driver rotates said agitator gear and said agitator gear rotates said operating lever.

22. The method of claim 18, said agitator gear further comprising a groove and said operating lever further comprising a protrusion received in said groove.

23. The method of claim 22, said protrusion further comprised of a length and said groove further comprised of a depth, said length being greater than said depth.

24. The method of claim 22, further comprised of said protrusion contacting said agitator gear when disengaged from said operating lever.

25. The method of claim 22, further comprised of said protrusion and said groove defining a helical formation about an axis of rotation of said operating lever and said agitator gear.

26. The method of claim 22, further comprised of when said operating lever is driven other than by said agitator gear, said protrusion ratchets beyond said groove.

* * * * *